United States Patent [19]

Herrod et al.

[11] 4,320,568

[45] Mar. 23, 1982

[54] METHOD OF EXPANDING TUBULAR MEMBERS

[75] Inventors: Clive A. Herrod; James G. Campbell, both of Derby, England

[73] Assignee: Northern Engineering Industries Limited, Newcastle upon Tyne, England

[21] Appl. No.: 227,359

[22] Filed: Jan. 22, 1981

[30] Foreign Application Priority Data

Feb. 14, 1980 [GB] United Kingdom ..... 04987/80

[51] Int. Cl.[3] ..... B23P 17/00

[52] U.S. Cl. ..... 29/421 R; 29/507; 29/523; 72/62; 72/370

[58] Field of Search ..... 29/237, 421 R, 507, 523; 72/61, 62, 370

[56] References Cited

U.S. PATENT DOCUMENTS

| | | | |
|---|---|---|---|
| 2,704,104 | 3/1955 | Mueller | 72/62 X |
| 2,971,556 | 2/1961 | Armstrong et al. | 72/370 X |
| 3,021,596 | 2/1962 | Yowell et al. | 72/370 X |
| 3,200,628 | 8/1965 | Polkowski | 72/62 |
| 4,152,821 | 5/1979 | Scott | 29/237 |

*Primary Examiner*—Leon Gilden

[57] ABSTRACT

A two-stage method of expanding tubes into holes in tubesplates including walls of drums and headers especially in boilers using an elastomeric body which in a first stage is compressed axially in the tube and which expands radially to expand the tube beyond its elastic limit into close engagement with the hole wall. In a second stage a second elastomeric body of different dimensions is compressed axially to stress the tube and an annular zone of the tubeplate around the tube beyond their elastic limits. Problems of excessive extrusion of and damage to the elastomeric body where tolerances on tube or hole diameter produces excessive clearances are avoided even where high expansion forces are used.

7 Claims, 12 Drawing Figures

METHOD OF EXPANDING TUBULAR MEMBERS

CROSS-REFERENCE TO RELATED APPLICATION

Reference may be had to the application filed on even date, Ser. No. 227,361, entitled "Apparatus for expanding tubular members" by Peter Frederick Hufton describing apparatus which may be used in the performance of the present invention.

BACKGROUND OF THE INVENTION

The invention relates to methods for use in joining tubular members to another member, such as a tubeplate for example by expansion of the tubular member; and to members so joined.

The expression tubeplate comprises a plate or other wall whether it is a wall of a header, a drum or some other component.

It has already been proposed in U.S. Pat. No. 4,006,619 to expand a tube by axially compressing an annular body of rubber or other elastomeric material within the tube by mechanically applied force so as to produce radial expansion of the body. In that method the annular body is supported at its ends by respective annular arrays of separate metal segments.

In that method, the tube is expanded only outside the tube-plate and the tubeplate is not stressed beyond its elastic limit by the expansion of the body of elastomeric material.

It has also been proposed in U.S. Pat. No. 4,068,372 to expand a tube within a tubeplate by axially compressing an annular body of elastomeric material within the tube so as to produce radial expansion of the body.

In that proposal, the annular body is supported at its ends by relatively hard seal rings of synthetic plastic material. In that proposal the length of the unstressed body of elastomeric material is less than the thickness of the tubeplate and the tube is expanded over a portion of its length within the tubeplate which portion is considerably less than the thickness of the tubeplate.

In the method proposed in U.S. Pat. No. 4,068,372, the tubeplate is not stressed across its full thickness by expansion of the tube and for optimum tube holding force and watertightness, it is proposed that the tube be expanded into annular grooves formed in the wall of the aperture in the tubeplate.

It has been proposed in British patent specification Nos. 1,534,107 and 1,543,524 to expand a tube within a tubeplate by pressurised hydraulic fluid acting directly on the inside of the tube. In that method it is proposed to expand the tubeplate by application of pressure greater than that value at which the unobstructed elastic recoveries of the tubeplate and the tube are equal. That is, after the expansion has been completed and the pressure is relieved, the tubeplate grips the tube tightly because of the residual stress in the tubeplate.

In the method proposed in British specification Nos. 1,534,107 and 1,543,524, pressure is applied to the tube over a portion of its length which is less than the thickness of the tubeplate.

It has been proposed in U.K. patent specification No. 1,489,719 to expand a tube within a tubeplate by applying hydraulic pressure over a portion of the length of the tube which is less than the thickness of the tubeplate and then to push the non-expanded part of the tube out of the tubeplate by mechanically rolling the tube internally in that expanded portion.

In using any of the methods referred to above, and as explained in U.K. specification No. 1,489,719, a difficulty arises in trying to ensure that the tube is expanded properly into contact with the tubeplate over the full thickness of the tubeplate; or alternatively, a difficulty arises in achieving any or adequate residual stress in the tubeplate.

Using such methods, where inadequate stress in the tubeplate is achieved or the tube is expanded into contact over less than the full thickness of the tubeplate, holding strength is lost and crevices may occurs at which corrosion may arise.

BRIEF SUMMARY OF THE INVENTION

The invention can overcome any one or more of those drawbacks, at least to a substantial extent, by expanding the tube in two stages.

In the first stage the tube is expanded into contact with the tubeplate using a first body of elastomeric material to stress the tube beyond its elastic limit; in the second stage the tube is expanded using a second body of elastomeric material having a dimension different from a corresponding dimension of the first body to stress beyond their elastic limits the tube and an annular zone of the tubeplate around the tube.

Such a method has the advantage that, where required, the tube can be expanded in the first stage into contact with the tubeplate throughout its thickness without risk of excessive stressing or damage to the tube outside the tubeplate. Generally, the pressure used in the first stage may be relatively low; or less than that required in the second stage. Furthermore, where required, the tube can be expanded over a portion of its length into tightly gripped engagement with the tubeplate which portion coincides with the full thickness of the tubeplate or is more nearly coincident therewith than has been possible using known methods. The change in length of the body of elastomeric material is relatively less and therefore the length of the portion of expanded tube is more accurately known. Furthermore, the application of high pressures in the second stage is facilitated because less stroke of the apparatus compressing the body of elastomeric material is wasted in taking up the initial clearance between the body and the tube.

The two-stage method is however not limited to such requirements and is applicable with advantage where those requirements do not arise.

It is preferred that the length of the first body of elastomeric material is greater than the thickness of the tubeplate both before and after completion of the first stage and that the body protrudes beyond both faces of the tubeplate after the completion of the first stage.

It is also preferred that the length of the second body of elastomeric material is greater than the thickness of the tubeplate at the start of the second stage and that after completion of the second stage the length of the surface of the stressed body contacting the tube is equal to and coincides with or closely corresponds to the thickness of the tubeplate.

Examples of methods and of members joined by their use will now be described to illustrate the invention with reference to the accompanying drawings, in which:

DETAILED DESCRIPTION OF PREFERRED EMBODIMENT

Figure 1:
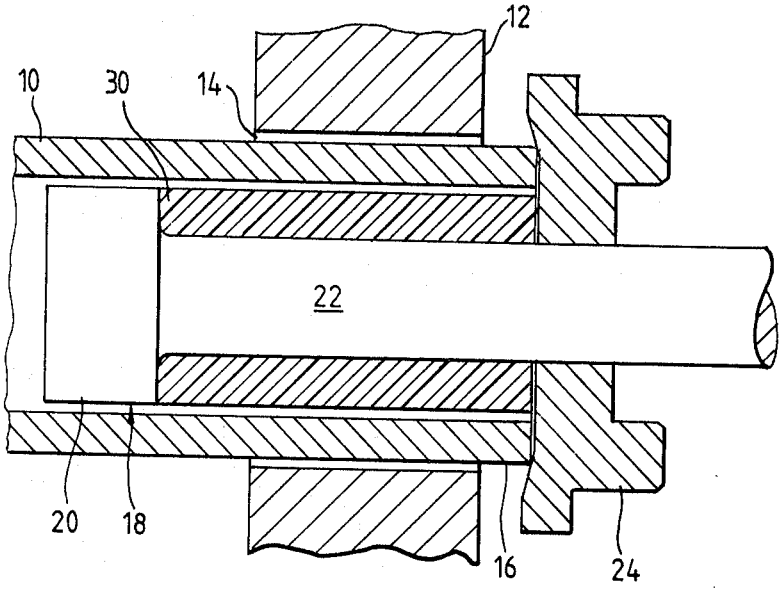
FIGS. 1 and 2 are diagrammatic longitudinal sections through apparatus and a circular-section tube showing, respectively, initial positioning of the tube in a round aperture in the wall of a drum, such as a boiler drum, and of the apparatus in the tube; and the effect of operation of the apparatus.
Figure 2:
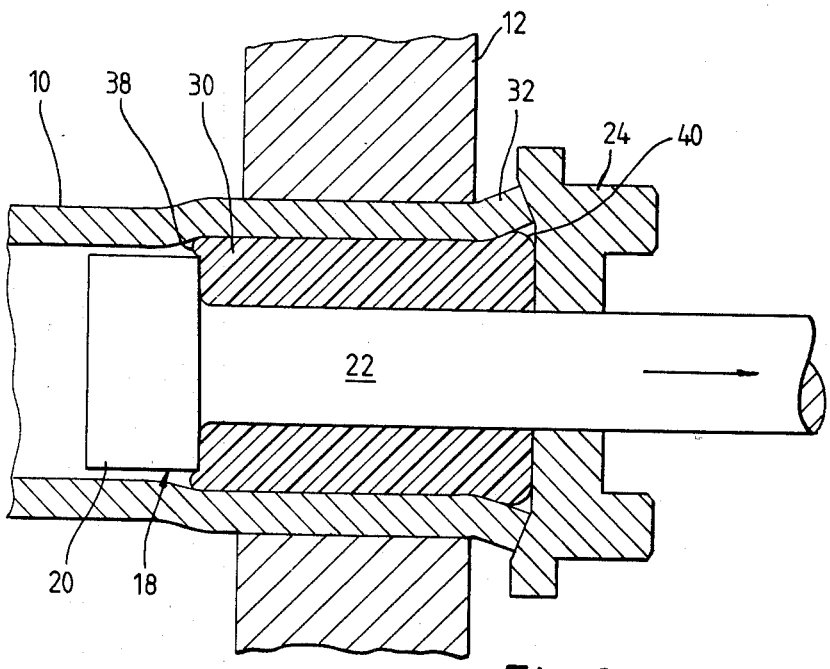

FIGS. 1 and 2 which are largely diagrammatic show the first stage of the two-stage method of expansion of a steel tube 10 within a steel wall 12 of a boiler drum having an aperture 14 through which the end 16 of the tube protrudes. The drum wall 12 is representative of many possible tubeplates or drum or similar members to which one or more tubes are to be joined, to make structures incorporating boiler riser tubes or take-off tubes for water tube boilers; or for fire tube boiler assemblies; or other applications.

Initially an expansion tool is positioned within the tube 10 as shown in FIG. 1. The tool comprises a mandrel 18 having a head 20 on a shaft 22 which slides through an annular pressure collar 24.

An annular body 30 of elastomeric material, in this case polyurethane having a hardness value at 80° Shore A (FIGS. 5 and 6) is located between the head 20 and the collar 24 around the shaft 22. The mandrel 18 is movable relatively to the collar 24 by hydraulic means (FIG. 13) to compress the body 30 axially as shown in FIG. 2 which causes the body 30 to expand radially and apply pressure generally uniformly over the inside of the tube 10. The tube 10 is thus stressed beyond its elastic limit and is expanded into contact with the wall of the aperture 14 as shown in FIG. 2, the end 16 of the tube 10 being belled at the same time as shown at 32 by the expansion of the body 30 at that region. The correct positioning of the body 30 is ensured by the plate 24 and mandrel 18.

In this first stage the drum wall 12 is not stressed or is only very slightly elastically stressed.

As a typical example, the tube 10 may have a 2 inch outside diameter and a wall thickness of 0.205 inch (50.8 millimeter o.d. and 5.2 mm wall thickness). The head 20 and the body 30 (when unstressed) have a nominal diametral clearance of 0.01 inch (0.25 mm) in the tube 10. The drum wall is 1.5 inches (38.1 mm) thick. The body 30 (unstressed) is 2.79 inches (70.9 mm) long, and has a wall thickness of 0.32 inches (8.1 mm).

Figure 5:
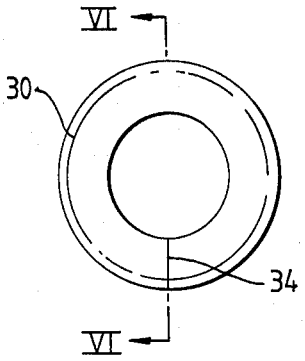
FIGS. 5 and 6 are respectively, an end view and transverse section on the line V1—V1 in FIG. 5 of the body of polyurethane used in the apparatus shown in FIGS. 1 and 2.
Figure 6:
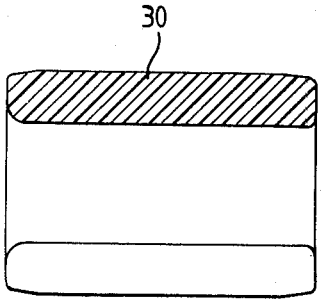

The body 30 is shown in detail in unstressed condition in FIGS. 5 and 6. The body is split at 34 to facilitate assembly onto the mandrel 18, then the ends are cemented together at 34.

At the maximum pressure used in this first stage the extrusion of the body 30 at its ends at 38 and 40 (FIG. 2) is not excessive and no special support is required at the ends of the body 30.

Figure 3:
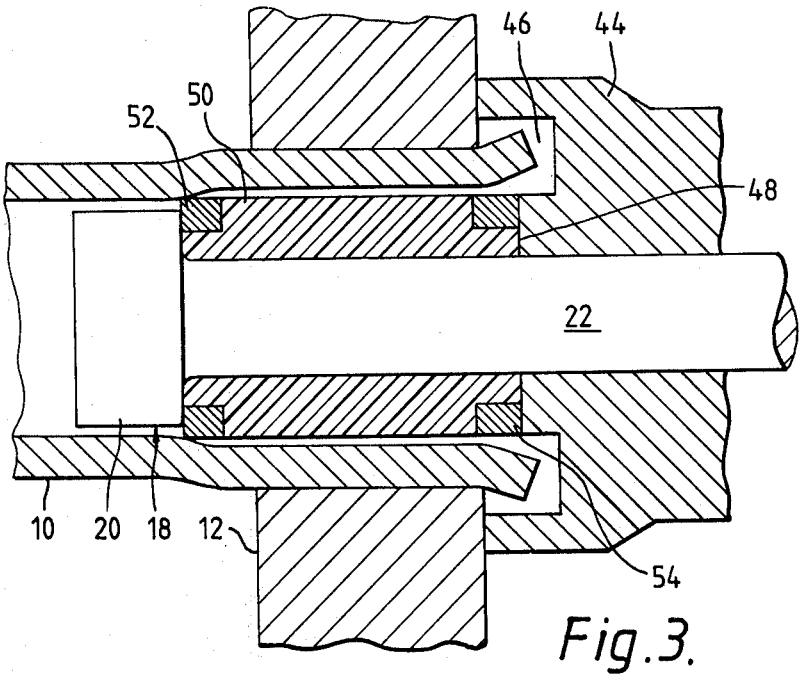
FIGS. 3 and 4 correspond to FIGS. 1 and 2 but show, respectively, initial positioning of modified apparatus after the completion of the stage shown in FIG. 2; and the effect of operation of the apparatus.
Figure 4:
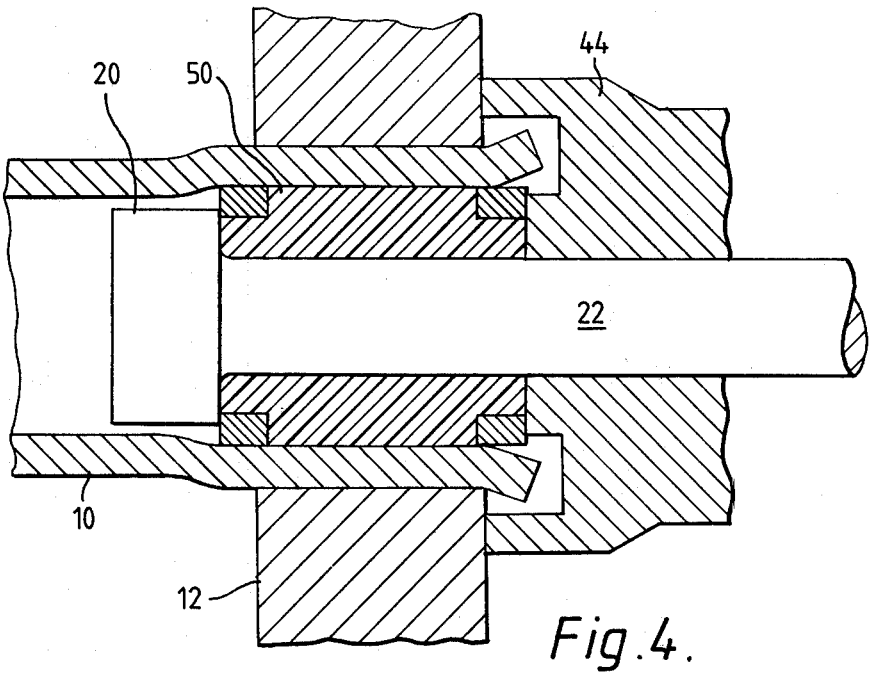

FIGS. 3 and 4 which are also largely diagrammatic show the second stage of expansion of the tube 10.

A similar tool (or the same tool modified) is used. However, in place of the collar 24 there is a collar 44 having an annular groove 46 to accommodate the bell 32 on the tube and arranged to engage one face of the drum wall 12 so accurately to position the stop face 48 of the collar 44 with respect to the surface of the drum wall.

There is a second type of body 50 of polyurethane of the same kind and hardness as the body 30 but having annular supports 52, 54 at its ends (see FIGS. 7 to 12). The body 50 is made up of two similar separate halves arranged back-to-back.

As shown in FIG. 3 at the start of the second stage the body 50 is accurately positioned against the stop face 48 of the collar 44, the support 54 also engaging the stop face 48. The supports 52 and 54 both lie outside the thickness of the wall 12.

The outer diameter of the body 50 and of the supports 52 and 54 is greater than that of the body 30 of the head 20.

Figure 7:
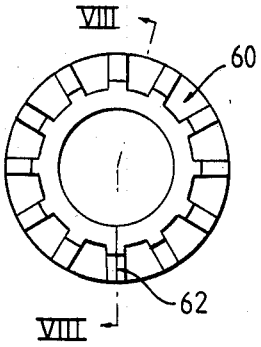
FIGS. 7 and 8 are views corresponding to FIGS. 5 and 6 but showing the body of polyurethane used in the apparatus shown in FIGS. 3 and 4.
Figure 8:
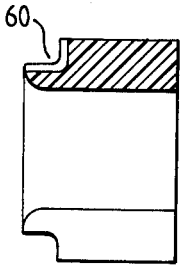
Figure 9:
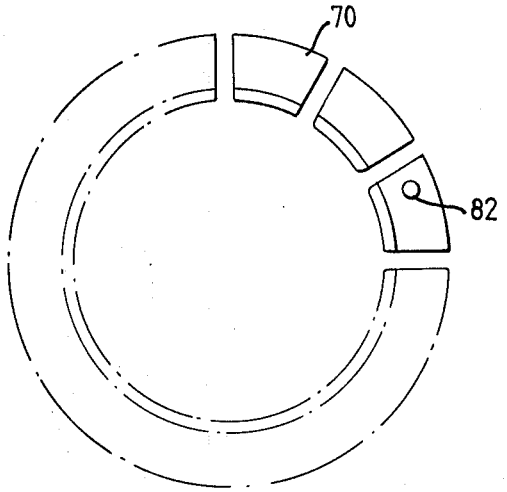
FIGS. 9 and 10 are respectively, an elevation of and section through a first kind of pieces of the array of pieces used in the apparatus shown in FIGS. 3 and 4.
Figure 10:
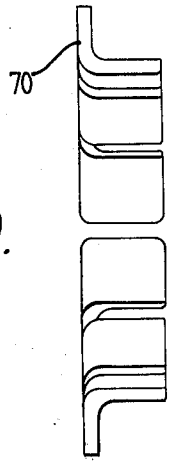

The dimensions of the body 50 which is made up of two of the halves shown in FIGS. 7 and 8 placed back-to-back are: length: 1.12 inch (28.4 mm); outer diameter: 1.55 inch (39.4 mm); wall thickness: 0.35 inch (8.9 mm).

Each half of the body 50 has at one end equi-spaced L-shaped recesses 60 to receive support pieces described below with reference to FIGS. 11 and 12. Each half body is split at 62.

Each support 52 or 54 consists of a closed annular array of separate metal pieces in which there are two kinds of piece. The first kind is segmental and L-shaped as shown at 70 in FIGS. 9 and 10 and they are located in the recesses 60 in the body 50. The pieces 70 are made by sawing an L-section ring into twelve equal pieces.

Figure 11:
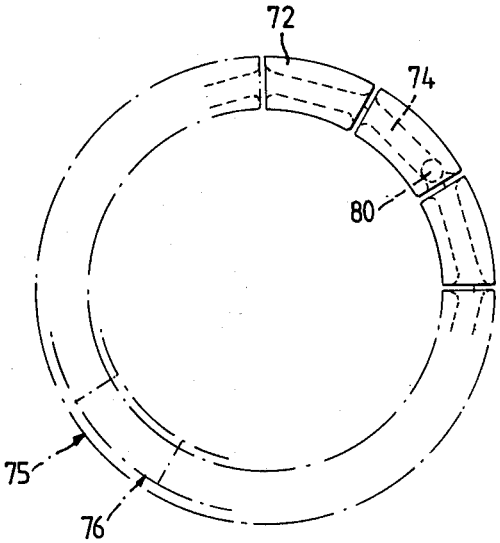
FIGS. 11 and 12 are respectively an elevation of and section through a second kind of pieces of the array used in the apparatus shown in FIGS. 3 and 4.
Figure 12:
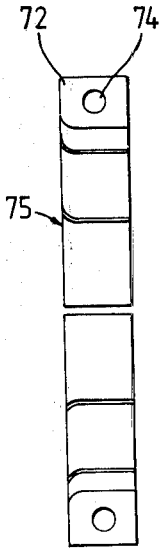

The second kind is segment shaped as shown at 72 in FIGS. 11 and 12.

In FIGS. 11 and 12 each piece 72 is shown having a through-passage 74. The pieces 72 are made by sawing through a machined ring (indicated at 75) to make twelve segments and so that after sawing the segments fit together to form a ring of a smaller diameter indicated by the ghost outline 76. The segments 72 are mounted on an elastic band (not shown) running through the passages 74.

In the array 52 or 54, the segments 72 are positioned around the limbs of the L-shaped pieces 70 which extend parallel to the shaft 22 of the mandrel 18. The complete array of pieces 70 and 72 is able to expand radially when the body 50 is axially compressed so as to ensure that, as the tube 10 expands, no gap exists through which the material of the block 50 can extrude. The radially extending limbs of the pieces 70 bridge the radial gaps between the pieces 72 and there is a hole 80 in one segment 72 (FIG. 9) to receive a pin 82 mounted on one piece 70 (FIG. 11) to ensure the required staggered relationship between the two kinds of piece, each of which is of hardened steel.

In the first stage of expansion, the compressibility of the body 30 is some 3.8% at a maximum elastomer pressure of some 25,000 pounds per square inch (1725 bar).

In the second stage the compressibility of the plug 50 is some 12.5% at a maximum elastomer pressure of some 65,000 psi (4,483 bar). In the second stage the wall 12 is stressed beyond its elastic limit. Preferably, an annular zone of the wall 12 around the aperture 14 of a diameter some 1.7 times the diameter of the aperture 14 is stressed beyond its elastic limit, though for some applications a lower degree of stressing of the wall 12 or the equivalent tubeplate may be acceptable.

Although it is preferred to perform the method using the apparatus described above it is possible to use different apparatus. For example, the apparatus used in the first stage may use a two-part body similar to the body 50; and the body may be supported at its ends by means similar to the supports 52 and 54, if desired.

The invention includes a structure including one or more tubes joined to a tubeplate or to a drum or header by the method according to the invention.

The invention is applicable to metals such as copper, titanium alloys, and zirconium alloys as well as to ferrous metals.

As typical examples the tube may be of steels such as BS 3059 Part I, Steel 33; or ASME II SA 192.

The drum wall or tubeplate may be of steel to BS 1501 223 32B; or ASME II SA 516 GR 70.

After the tube has been expanded using the two-stage method described the tube can resist a pull out load of up to eight tons (80 kN) in the case of a 2 inch (50 mm) outside diameter tube.

The method is not limited to applications in which the tubeplate has to be stressed beyond its elastic limit, though for applications where maximum or very high tube pull-out values are required it is essential that the tubeplate is stressed beyond its elastic limit. In all cases the tube may be stressed beyond its elastic limit.

In certain cases, for example, where a relatively thick-walled tube is required to be expanded in a tubeplate the tolerance variation on the tube wall thickness may be very great for example, the thickness may vary from 0.176 inch (4.47 mm) to 0.25 inch (6.35 mm) in tube of nominal 0.22 inch (5.59 mm) wall thickness. This means that the clearance between the head 22 (which must fit into tubes having maximum wall thickness) in tubes of minimum wall thickness is for many tubes relatively great. Such large clearances may require a support of the kind used in the second stage to be used in the first stage, positioned against the head 20 to prevent extrusion of elastomeric material past the head.

This enables large numbers of tubes to be expanded quickly and economically without the need to replace the body 30 at frequent intervals.

Another modification (not shown) is to arrange a steel annular member against the head 20 with the shaft 22 extending through the member. The member can readily be replaced by another similar member of greater or less diameter to suit different inside diameters of the tubes so as to reduce the clearance through which the elastomeric material may extrude.

Such members may be used in either stage and may be used in the first stage with or without supports in the form of the closed annular arrays described.

The head 20 is integral with the shaft 22 for strength and good fatigue life under cyclic stressing, rather than being detachable. A detachable head may be used in certain applications, however.

Apparatus for use for example at least in the second stage is described in said patent application, Ser. No. 227,361, filed on the same date as the present application.

In the method described above, it should be noted that the outer diameter of the annular stop face 48 is greater than that of the head 20. The diameter of the stop face 48 is not restricted by tolerances on the inner tube diameter. The clearances shown between the tube and the body 50 in FIG. 3 and between the head 20 and the tube in FIGS. 3 and 4 have been exaggerated for clarity.

What is claimed is:

1. A method of expanding a tubular member within a tubeplate comprising a first stage in which the tube is expanded into contact with the tubeplate using a first body of elastomeric material to stress the tube beyond its elastic limit and a second stage in which the tube is expanded using a second body of elastomeric material having a dimension different from a corresponding dimension of the first body to stress beyond their elastic limits the tube and an annular zone of the tubeplate around the tube.

2. A method according to claim 1, in which the length of the first elastomeric body is greater than the length of the second body.

3. A method according to claim 1 or claim 2, in which the length of the first body is greater than the thickness of the tubeplate both before and after completion of the first stage and in which the body protrudes beyond both faces of the tubeplate after completion of the first stage.

4. A method according to claim 1, in which the length of the second body is greater than the thickness of the tubeplate at the start of the second stage and in which the length of the surface of the stressed body contacting the tube is equal to and corresponds to the thickness of the tubeplate.

5. A method according to claim 1, in which the annular zone of the tubeplate has a diameter which is 1.7 times the diameter of the aperture in the tubeplate into which the tube was inserted.

6. A method according to claim 1, in which in each stage the body is compressed between a head of a mandrel extending through the body and a collar surrounding the mandrel, and in which in at least the second stage the body has end portions of reduced diameter on which there are respective annular expansible supports which engage the head or collar and the inside of the tube.

7. A method according to claim 1, in which in the first stage a portion of the tube adjacent an open end of the tube is expanded outside the tubeplate.

* * * * *

UNITED STATES PATENT AND TRADEMARK OFFICE

CERTIFICATE OF CORRECTION

PATENT NO. : 4,320,568

DATED : Mar. 23, 1982

INVENTOR(S) : Clive A. Herrod and James G. Campbell

It is certified that error appears in the above—identified patent and that said Letters Patent is hereby corrected as shown below:

Column 5, lines 35-40 is amended to read:

-- The tube and the tubeplate have to be stressed beyond their elastic limits to give very high tube pull-out values. --.

Signed and Sealed this

*Fifth* Day of *October 1982*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,320,568

DATED : March 23, 1982

INVENTOR(S) : Clive A. Herrod et al

It is certified that error appears in the above-identified patent and that said Letters Patent is hereby corrected as shown below:

Column 6, line 23, claim 1, "tubular" should read --tube--.

Signed and Sealed this

*Fifth* Day of *April 1983*

[SEAL]

*Attest:*

GERALD J. MOSSINGHOFF

*Attesting Officer*

*Commissioner of Patents and Trademarks*